US005607256A

United States Patent [19]

McCleary

[11] Patent Number: 5,607,256

[45] Date of Patent: Mar. 4, 1997

[54] ADJUSTABLE FLOOR TILE MORTAR AND GROUT SPREADER

[75] Inventor: Michael D. McCleary, Delray Beach, Fla.

[73] Assignee: McCleary Concepts & Creations, Inc., Delray Beach, Fla.

[21] Appl. No.: 386,737

[22] Filed: Feb. 10, 1995

[51] Int. Cl.[6] ..... B28B 19/00; E01C 19/48

[52] U.S. Cl. ..... 404/105; 404/107; 404/118; 15/235.8; 15/236.08; 15/245.1; 118/413

[58] Field of Search ..... 404/73, 82, 96, 404/97, 105, 106, 107, 118, 119, 120, 101, 104, 111, 110; 172/387, 393, 445.1, 684.5, 736, 738; 101/123, 127.1; 118/413, 415; 156/574; 425/87; 15/235.6, 235.8, 236.08, 245.1

[56] References Cited

U.S. PATENT DOCUMENTS

| | | | |
|---|---|---|---|
| 918,993 | 4/1909 | Gaiwes | 404/118 X |
| 1,230,768 | 6/1917 | Parrish | 404/106 X |
| 4,507,015 | 3/1985 | Furukawa et al. | 404/118 X |
| 4,678,365 | 7/1987 | Ban et al. | 404/118 |
| 4,804,321 | 2/1989 | Riesgo | 15/235.6 X |
| 4,917,533 | 4/1990 | Wilson | 404/75 |
| 5,191,943 | 3/1993 | Minor et al. | 172/393 |
| 5,302,051 | 4/1994 | Wilson, Sr. | 404/84.1 |
| 5,387,051 | 2/1995 | Valrmte | 404/101 X |
| 5,392,538 | 2/1995 | Geerligs et al. | 37/268 |

*Primary Examiner*—James A. Lisehora

[57] ABSTRACT

An adjustable, floor tile mortar and grout spreading device for applying bonding material at a predetermined thickness in an efficient manner, and for spreading grout between floor tiles. The device comprises a telescopically adjustable rectangular frame having a leading edge and a trailing edge and a pair of downwardly extending sides for containing bonding material. The rectangular frame is telescopically adjustable to various widths and can be fixed at a particular width depending upon the size tile for the given installation. In one embodiment, the trailing edge incorporates a downwardly extending trowel blade having a conventional trowel blade edge with either a saw-tooth or square-toothed shape. The trowel blade is adjustable such that the device may be used for spreading various thicknesses of bonding material. Bonding material poured onto the subfloor between the frame leading edge and trailing edge is spread by sliding the device across the sub-floor such that the trailing edge trowel spreads the bonding material uniformly. In the grout spreading configuration, the trowel blade is replaced by a first grout float and a second grout float acting as a squeegee is attached at the trailing end for spreading grout into the gaps existing between individual tiles.

10 Claims, 6 Drawing Sheets

ADJUSTABLE FLOOR TILE MORTAR AND GROUT SPREADER

BACKGROUND OF THE INVENTION

1. Field of the Invention

This invention relates to a device for spreading floor tile bonding material, and more particularly this invention relates to an adjustable device for spreading floor tile mortar at a predetermined thickness over a predetermined area of sub-flooring in an efficient and uniform manner; the device further being adjustable such that the device is capable of filling the spaces between the tiles with grout.

2. Description of the Prior Art

Ceramic flooring tiles are bonded to a variety of subfloors using bonding material including thin set mortar and grout. The term thin set mortar is used to describe the method of installing tiles with bonding material that is usually 3/32 of an inch to 1/8 of an inch in thickness. In other installations, a mortar bed up to two inches in thickness facilitates accurate slopes or planes in finished tile work on floors and walls. Portland Cement Mortar, comprising a mixture of Portland cement and sand, is suitable bonding material for most surfaces in ordinary types of installations.

Portland Cement is the base for most grout and is modified to provide specific qualities such as whiteness, mildew resistance, uniformity, hardness, flexibility and water retentiveness. Non-cement based grouts such as epoxies, furans and silicone rubber offer properties not possible with cement grouts.

Typically, bonding material is spread on an underlying sub-floor using a hand trowel. Hand trowels typically incorporate a trowel blade having serrated edges in the form of a square or sawtooth wave. Trowels are specially sized for spreading a particular thickness of bonding material wherein a larger square wave configuration is used for spreading a thick layer of mortar, and a smaller square wave configuration is used for spreading thinner layers of mortar.

It is very important that the mortar is spread evenly at a predetermined thickness for a given type of ceramic tile for installation. Obtaining an even layer of bonding material requires a high degree of skill on the part of the installer. In addition, because mortar begins to set or cure, the installer typically applies mortar over a relatively small area, subsequently changing over to a tile laying mode and installing the tile over the freshly mortared surface.

Since spreading mortar evenly and efficiently over a sub-floor surface is highly important and requires skill, and since frequent changeover from mortar spreading to tile laying is inefficient, a number of devices have been developed to improve the spreading process.

For example, U.S. Pat. No. 5,319,825 issued to Fanning on Jun. 14, 1994, discloses a concrete trowel extension. The extension has a flat upright frame with a pair of handles at the top for operating the frame and a trowel. A trowel is secured to the bottom of the frame by an adjustable clamp. The invention is directed toward a combined system including an extension on a conventional trowel that permits the user to apply pressure more accurately.

U.S. Pat. No. 4,723,869 issued to Dragich on Feb. 9, 1988, discloses a long-handled trowel with adjustable weights. The invention includes a trowel having a blade assembly, a reinforcing rib base mounted on the trowel's upper surface, and a handle pivotally connected at one end portion to the blade assembly such that an operator can move the blade member over the surface from a remote location. In addition, the invention contemplates adjustable weights which can be selected, added to or taken away from the blade assembly to vary the effective weight of the trowel. In this invention, the adjustable weights do not adversely affect the flexibility of the trowel blade proximate its edge portion such that a flexible blade serves to enhance the smoothness of the surface produced by the device.

Furthermore, floor tiles are typically installed in spaced relation such that a gap exists between adjacent tiles. While gap size varies depending upon the installation, 1/8 inch to 3/4 inch gaps are typical. After the tiles are set and bonded by the mortar, grout must be applied in a squeegee like manner such that these gaps are filled.

Thus, there still exists a need for a combination mortar and grout spreader having an adjustable trowel for spreading mortar over a sub-floor for efficiently spreading a large quantity of mortar in a single pass, and also used for filling the spaces between the tiles with grout.

In each of the prior art devices, however, pressure applied by the user on the trowel handle may adversely affect pressure on the trowel blade resulting in uneven spreading.

A further disadvantage with the prior art trowels is that the user must first provide a supply of mortar, typically by scooping the mortar using a hand trowel or other device from a bucket and then smoothing the mortar using the trowel. Therefore, should the user apply too much bonding material for a given area, the bed may be too thick. On the other hand, should the user not apply enough bonding material, the resulting bed may be too thin. Furthermore, should the user apply the bonding material by applying uneven pressure, the bed may be uneven. Thus there still exists a need for an automatic spreader wherein a measured quantity of bonding material may be placed for automatic distribution across the underlying sub-floor.

SUMMARY OF THE INVENTION

The instant invention is designed to overcome the aforementioned disadvantages present in the prior art. The invention contemplates an adjustable, mortar and grout spreading device for applying tile bonding material at a predetermined thickness in an efficient manner and for applying grout for filling tile gaps. The device comprises a telescopically adjustable rectangular frame having a leading end and a trailing end and a pair of downwardly extending sides, terminating in scratch resistant plastic skids, for containing mortar and grout. The rectangular frame is telescopically adjustable to various widths and can be fixed at a particular width depending upon the size tile for the given installation. In the preferred embodiment, the trailing end incorporates a detachable, downwardly extending trowel blade having a conventional trowel blade edge such as a saw-tooth or square-toothed shape. The trowel blade is adjustable in height, and is also removably attached to the trailing end such that the device may be used for spreading various thicknesses of mortar either by vertically adjusting the trowel blade or by attaching a trowel blade with a different trowel blade tooth size. Once the tile is installed and allowed to set, the trowel blade may be replaced with a downwardly extending grout blade or float having a squeegee like edge for applying grout between the tiles.

To use the device, the tile installer sets the width, for example, just over thirty-six inches for accommodating a row of three twelve inch tiles, pours a supply of mortar onto the underlying sub-floor in the middle of the rectangular frame, and proceeds to drag the device such that the trailing end of the device incorporating the downwardly extending trowel blade levels the mortar to a particular thickness. Weights, consisting of spare flooring tiles or bricks are placed on the trailing end corners of the frame to insure adequate pressure on the underlying trowel blade. Further, rope may be attached to the frame leading end for enabling the user to easily drag the device across the sub-floor. Therefore, the device allows for spreading an even layer of mortar at a predetermined thickness over a relatively large area in a single pass.

Once the mortar layer is applied and floor tiles are installed and allowed to set, the device is converted to a grout spreader by replacing the trowel blade with a grout float for smoothing grout into the spaces between the tiles. In addition, a sponge like squeegee is installed at the trailing end of the device for removing excess grout from the surface of the floor tiles.

It is an object of the present invention to provide an improved tile mortar spreading device for applying floor tile mortar, such as thin set mortar, to an underlying sub-floor.

Another object of the present invention is to provide an adjustable bonding material spreading device whereby a supply of bonding material may be evenly applied to a sub-floor by filling the device with the desired quantity of bonding material and dragging the device across the sub-floor.

Still another object of the instant invention is to provide an adjustable bonding material spreading device capable of spreading bonding material across a user selected width of sub-flooring.

Yet another object of the instant invention is to provide a spreading device that may be converted for applying grout in the gaps existing between the installed tiles.

A further object of the instant invention is to provide a bonding material spreading device that collapses for convenient handling and storage.

In accordance with these and other objects which will become apparent hereinafter, the instant invention will now be described with particular reference to the accompanying drawings.

DESCRIPTION OF THE PREFERRED EMBODIMENTS

Figure 1:
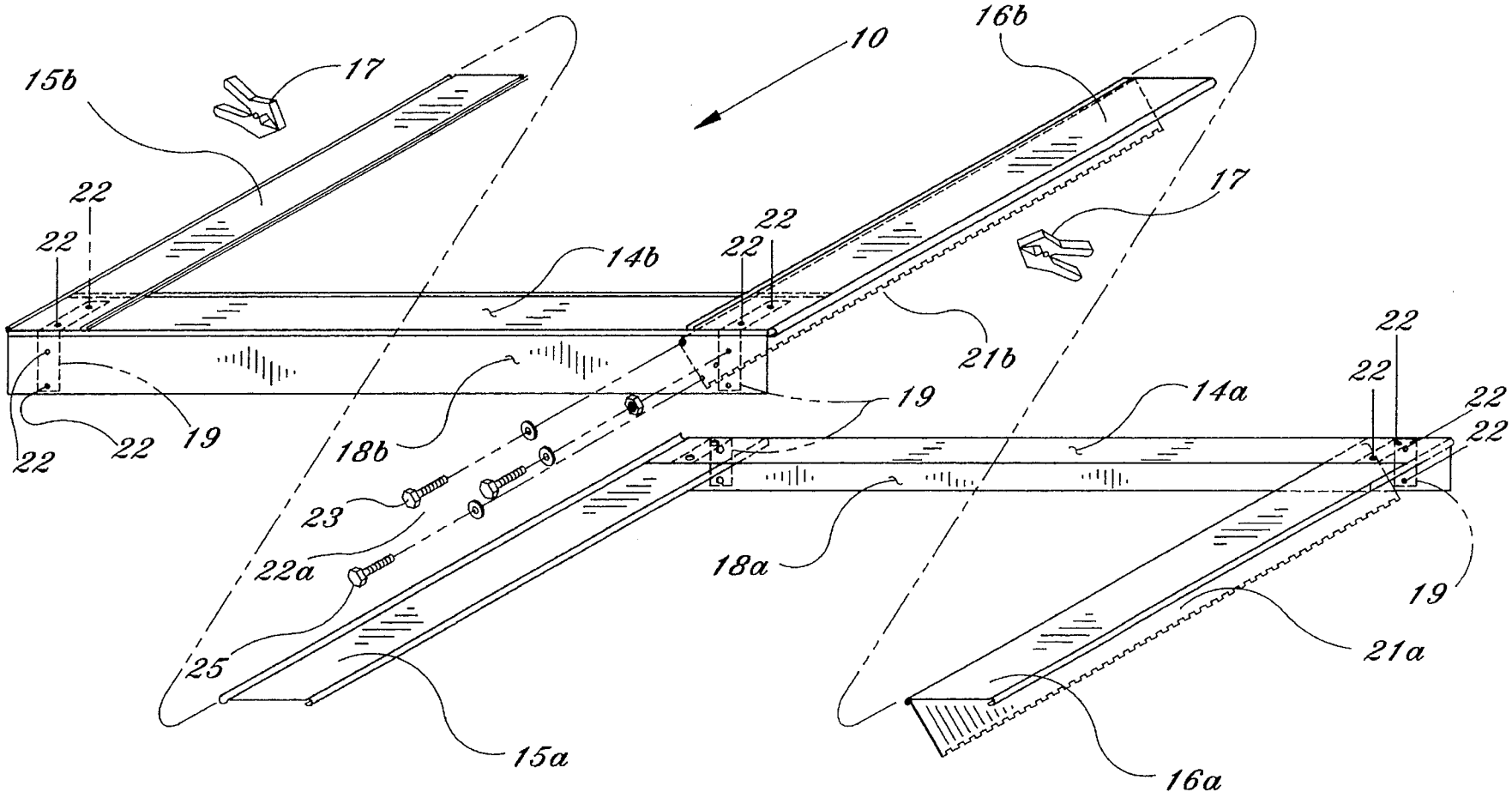
FIG. 1 is an exploded view of the instant device.
Figure 2:
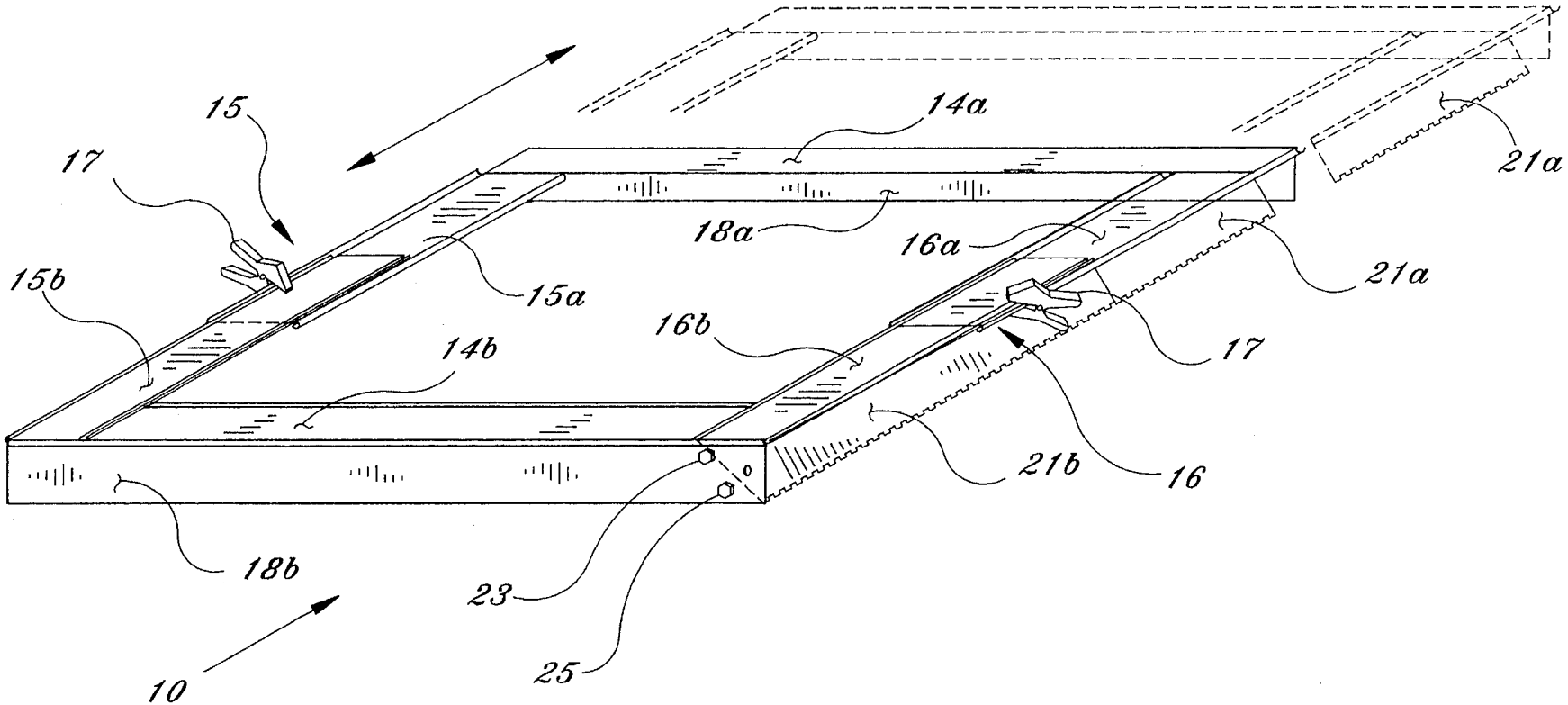
FIG. 2 is a perspective view of the instant device illustrating telescopic adjustment.

Referring now to the drawings, FIGS. 1–12 depict the adjustable, spreading device for applying floor tile mortar and grout, generally designated by reference numeral 10. The device includes a rectangular frame formed by a pair of telescopically adjustable U-shaped sections 14*a* and 14*b* respectively. Each U-shaped section, 14*a* and 14*b*, has a pair of extending arms 15*a* and 16*a*, and 15*b* and 16*b* respectively, in overlapping telescoping engagement such that the width of the frame may be adjusted by the user as illustrated in FIG. 2.

Figure 4:
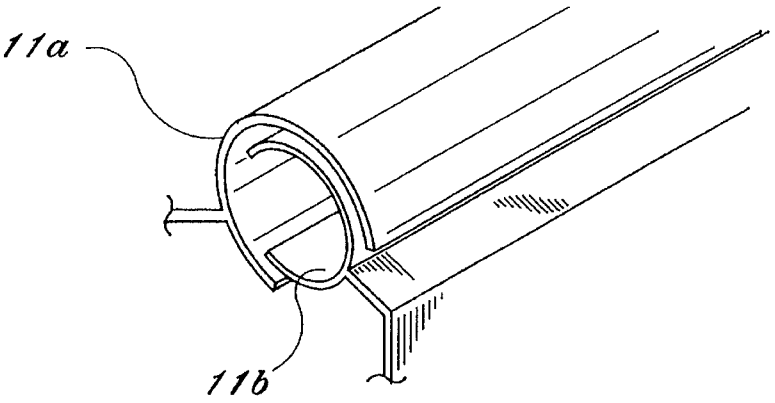
FIG. 4 is a detail of the interlocking assembly that allows for slidable engagement.

In the preferred embodiment, the frame is formed by inter-locking aluminum structural components, reinforced by L-shaped reinforcing members 19 having apertures 22 therein and being secured at the frame corners by conventional fasteners 22*a*. Each aluminum structural component incorporates a formed edge 11*a* and 11*b*, respectively, for inter-locking with the formed edge of a cooperating component as best seen in FIG. 4. Thus extending arms 15*a* and 15*b*, and 16*a* and 16*b*, are slidably engaged by cooperating, inter-locking edges. Thus, the rectangular frame is telescopically adjustable to various widths and can be fixed at a selected width by using clamps 17, or any suitable means.

The frame further incorporates downwardly extending opposing sides 18*a* and 18*b*. Sides 18*a* and 18*b* function to contain bonding material while serving as skids for sliding the device across a sub-floor, as will soon become apparent. Sides 18*a* and 18*b* may terminate in plastic coated skid edges to prevent scratching of the underlying surface, a feature particularly desirable when the device is used for spreading grout between the gaps of installed tiles.

Figure 3:
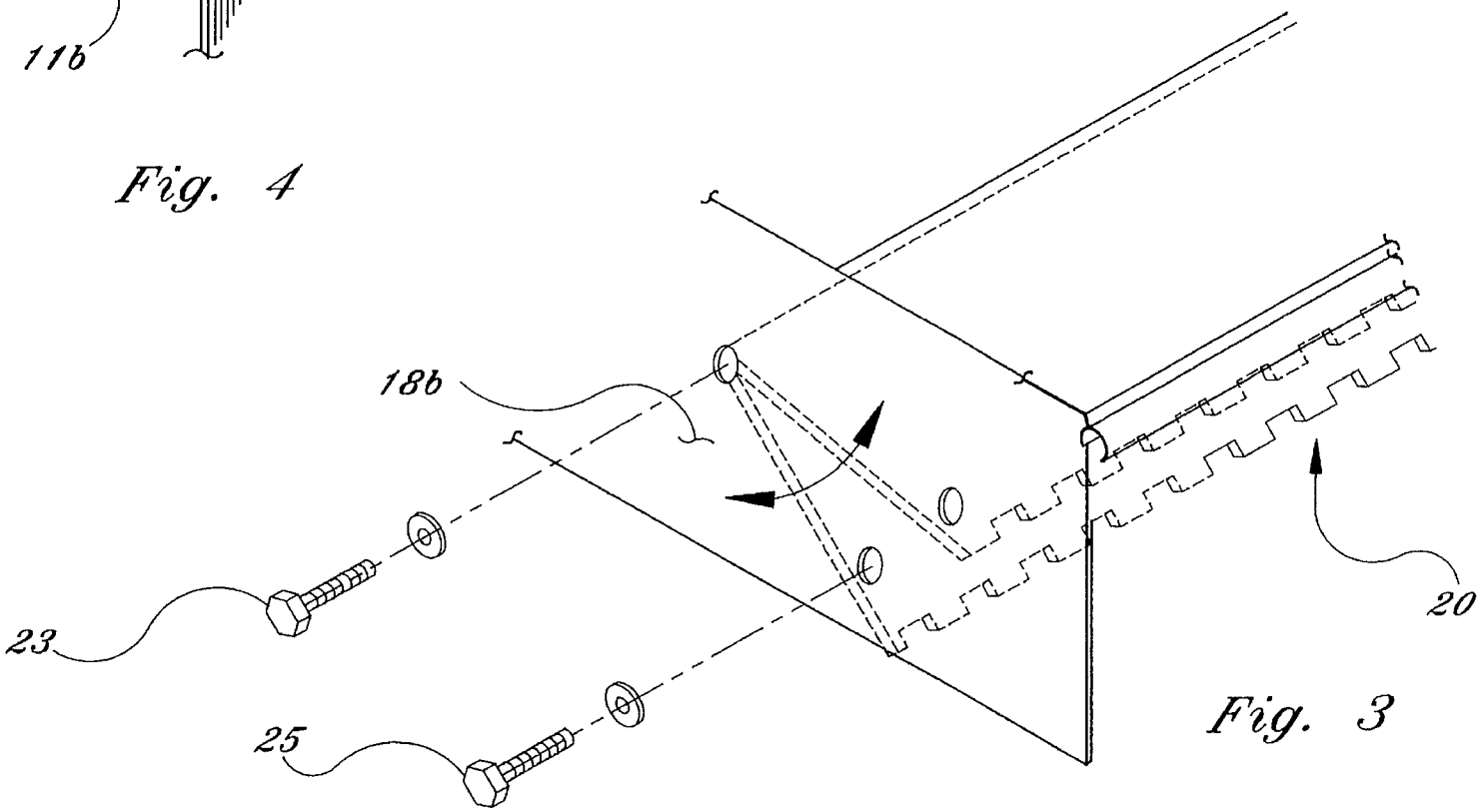
FIG. 3 is a detail of the trowel blade adjustment assembly.
Figures 11, 12:
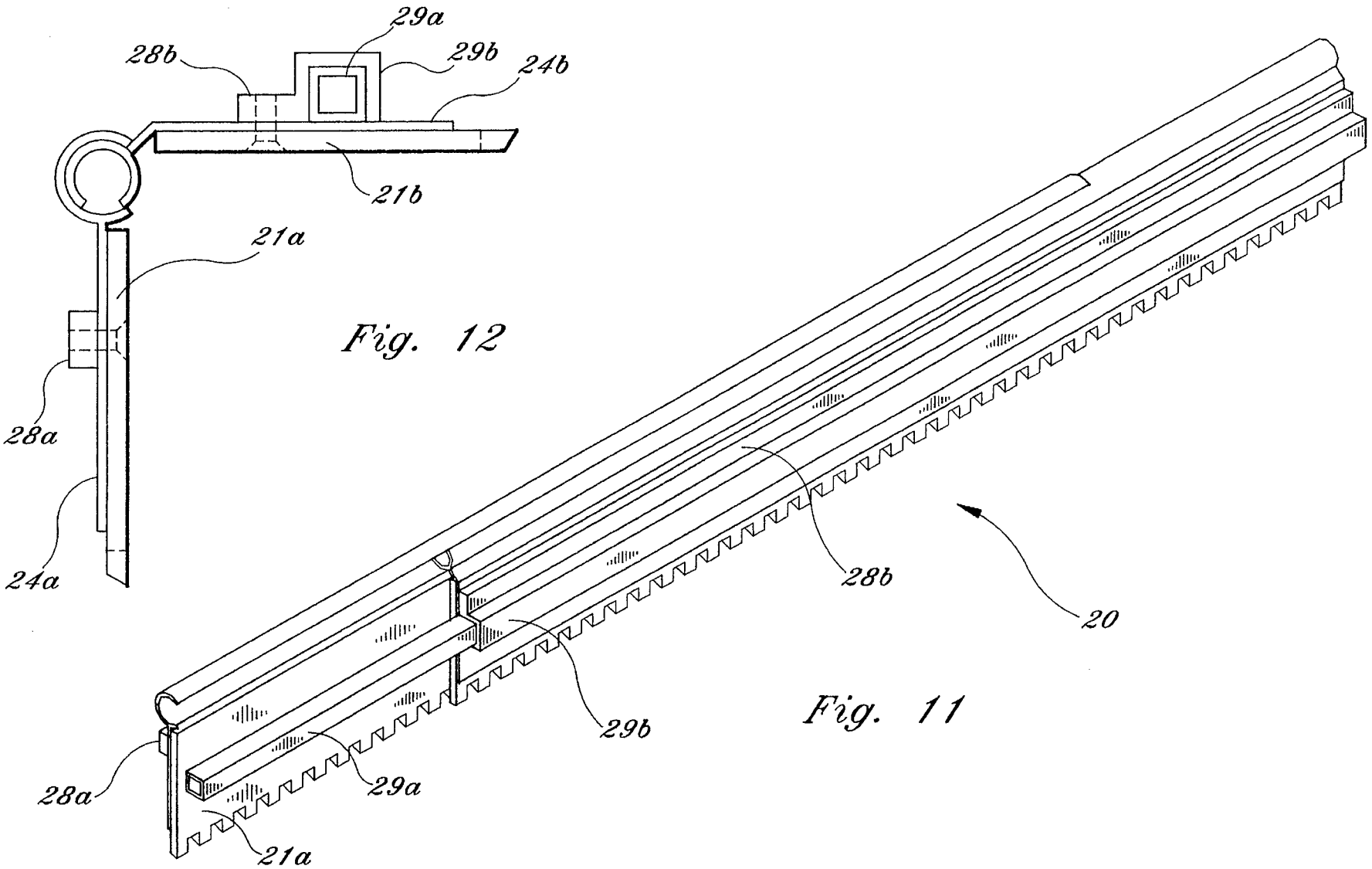
FIG. 11 is a perspective view of the spreading bar assembly of the instant device.
FIG. 12 is a side elevational view of the spreading bar assembly of the instant device.

Telescoping arms 15*a* and 15*b* form a leading end 15 of the device 10, while arms 16*a* and 16*b* form the trailing end 16 of the device for reasons that will soon become apparent. A telescoping spreading bar assembly, generally designated by reference numeral 20, is movably secured proximate said device trailing end, extending downwardly beneath arms 16*a* and 16*b*. Spreading bar assembly 20 includes a spreading bar comprising spreading bar sections 24*a* and 24*b* as best depicted in FIGS. 11 and 12. Spreading bar sections 24*a* and 24*b* are each pivotally secured at one end to sides 18*a* and 18*b* respectively by fasteners 23 as seen in FIGS. 1 and 2. For clarity, only trowel blade sections 21*a* and 21*b* are shown in FIGS. 1–3 and 5–7. It should be understood however that in the preferred embodiment the entire spreading bar assembly as depicted in FIGS. 11 and 12 is to be utilized to add strength to trowel blade sections 21*a* and 21*b*. However, in an alternate embodiment, it is contemplated that the trowel blade may be utilized without the need for the entire spreading bar assembly, such as having a spreading bar with trowel blade teeth disposed on a lower edge thereon as seen in FIGS. 1–3. Opposing spreading bar section ends are slidably engaged with one another such that spreading bar 20 expands and contracts telescopically in unison with arms 16*a* and 16*b*.

As best depicted in FIGS. 11 and 12, spreading bar assembly 20 has a telescoping trowel blade comprising telescoping trowel blade sections 21*a* and 21*b* attached thereto. Trowel blade sections 21*a* and 21*b* are each adjustable in height and are removably attached to spreading bar sections 24*a* and 24*b*, respectively. A reinforcing bar comprising reinforcing bar sections 28*a* and 28*b* are attached to spreading bar sections 24*a* and 24*b*, respectively, and in the preferred embodiment are threaded to allow the attachment of removable trowel blade sections 21*a* and 21*b* to spreading bar sections 24*a* and 24*b*. A telescoping stabilizer bar comprising telescoping stabilizing bar sections 29*a* and 29*b* are disposed on the outer surface of spreading bar sections 24*a* and 24*b*, respectively, thereby preventing spreading bar assembly 20 from bowing when the device 10 is in use. The trowel blade sections 21*a* and 21*b* are adjustable in height such that the device 10 is used for spreading various thicknesses of mortar. Further, a variety of trowel blade tooth sizes (e.g. ¼ in.×¼ in., ½ in.×½ in., ¼ in.×⅜ in., etc.) may be used by the installer depending upon the thickness of mortar layer desired.

As best depicted in FIG. 3, telescoping trowel blade sections 21*a* and 21*b* each terminate in a lower edge having a square-toothed configuration. However, it is contemplated that any conventional trowel blade configuration (e.g. square-toothed, saw-toothed, etc.) may be utilized. Spreading bar assembly 20 is pivotally adjustable, as seen in FIG. 3, such that the height of the lower trowel blade edge above the sub-floor may be adjusted by the user for spreading the desired thickness mortar bed. If a thin layer of bonding material (e.g. mortar) is desired, spreading bar assembly 20 is pivoted downward and secured by an anchoring pin 25. If, on the other hand, a thicker layer of bonding material is desired, spreading bar assembly 20 is pivoted upward such that the blade edge is raised higher above the sub-floor, and secured by anchoring pin 25.

Figure 5:
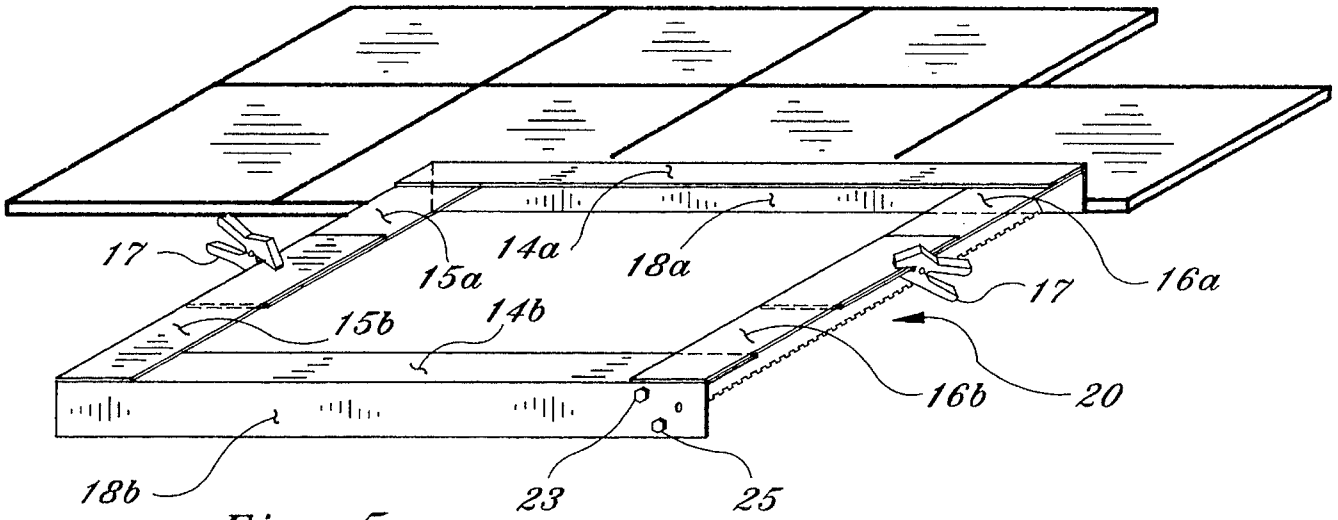
FIG. 5 illustrates the mortar spreading device on an untiled sub-floor.

To use the device, the user adjusts the frame to a width, depending on the size of the tiles and the amount of bonding material desired, by removing clamps 17 and expanding or contracting U-shaped sections 14*a* and 14*b* such that arms 15*a*, 15*b*, 16*a*, 16*b*, and spreading bar assembly 20 telescopically expand or contract. The user then fixes the device at the desired width by anchoring arms 15*a* and 15*b*, and 16*a* and 16*b* with clamps 17. In the preferred embodiment, the width is adjustable between twenty four and forty eight inches, however other widths are contemplated. For example, the installer may adjust the width to just over 36 inches for spreading bonding material for laying rows of three twelve inch tiles. The device 10 is then placed on the sub-floor at a desired location such that the spreading bar assembly 20 is positioned at the desired starting point for a new mortar layer, as best illustrated in FIG. 5.

Figure 7:
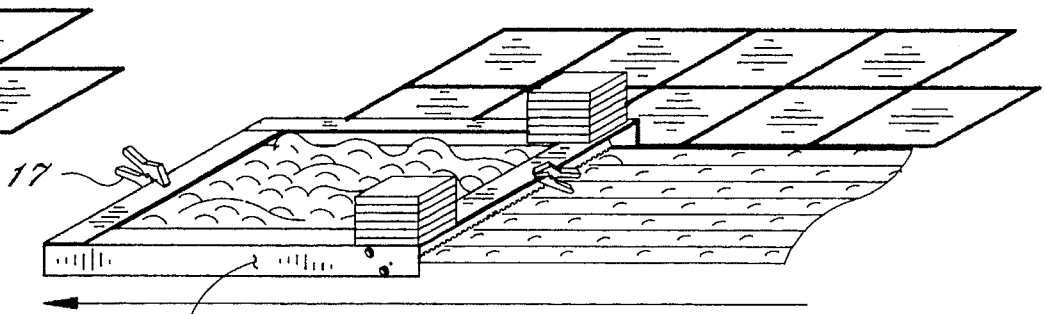
FIG. 7 illustrates the mortar spreading device moved along the supporting sub-floor leaving a layer of mortar in its wake.
Figure 6:
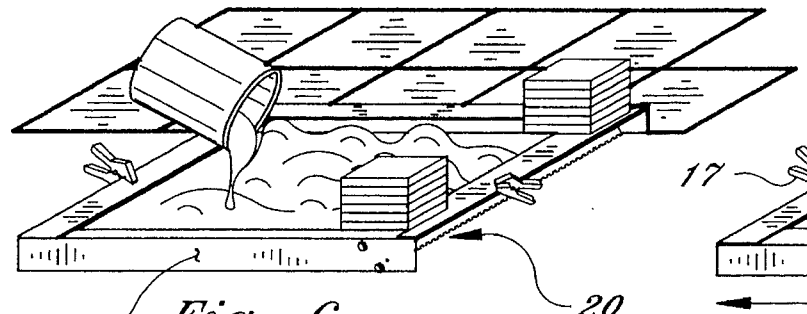
FIG. 6 illustrates the mortar spreading device filled with a supply of mortar.

Next, as best illustrated in FIG. 6, the user mixes, or otherwise obtains, the proper mortar mixture such as thin set mortar, and pours the mortar (e.g. the device is capable of holding at least a five gallon bucket of mortar) directly onto the sub-floor area framed by the device 10 such that, when poured, the material is confined by the device's opposing sides 18*a* and 18*b* and the spreading bar assembly 20. In addition, weight is added to maintain the spreading bar assembly 20 at the proper height by placing weighted objects, such as spare floor tiles, on the frame's corners as seen in FIGS. 6 and 7. The user then slides the device 10 in the direction indicated by the arrow in FIG. 7, causing trowel blade sections 21*a* and 21*b* to pass over the mortar bonding material thereby spreading a bonding material layer of uniform thickness in its wake. Therefore, the device allows for spreading a uniform layer of mortar at a predetermined thickness over a relatively large area in a single pass.

Figure 8:
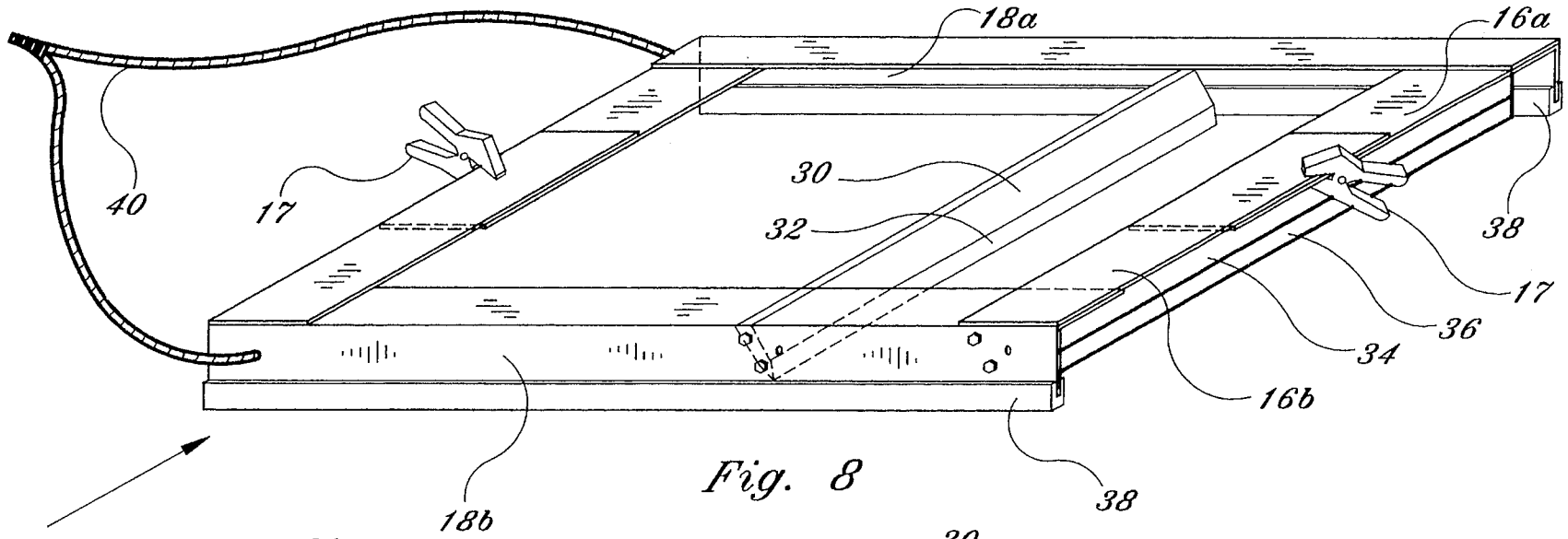
FIG. 8 illustrates an alternate embodiment of the instant device wherein the device has been converted into a grout spreader.
Figure 10:
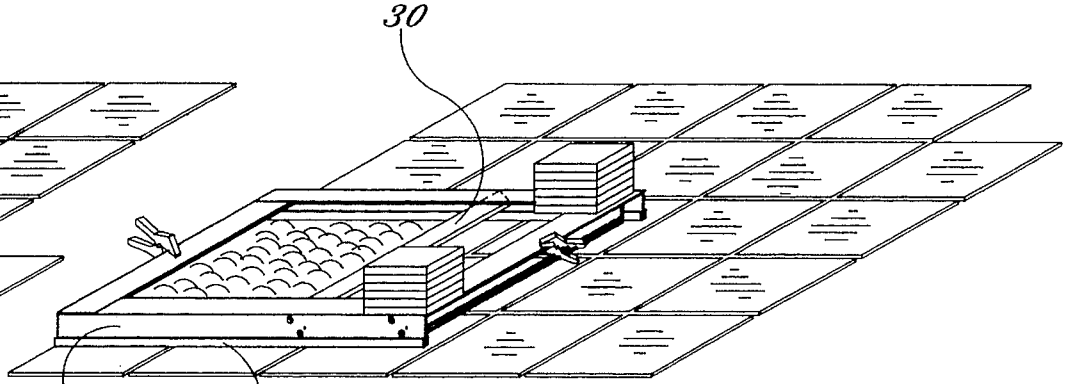
FIG. 10 illustrates the grout spreading device moved along the tile surface.
Figure 9:
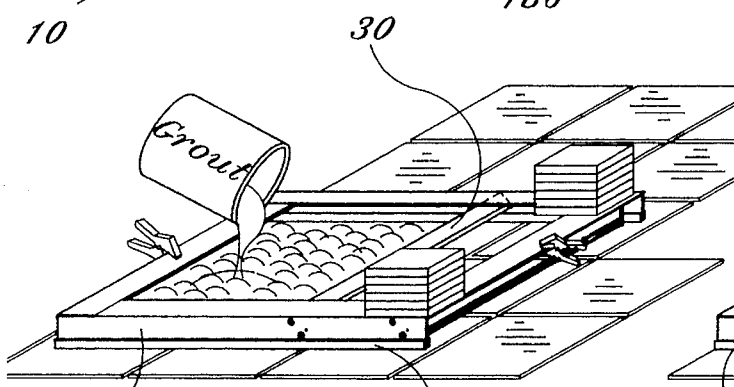
FIG. 9 illustrates the grout spreading device filled with a supply of grout.

As seen in FIGS. 8–10, once a layer of mortar is spread and tiles are installed thereon, the device 10 is converted to a grout spreader wherein the trowel blade sections 21*a* and 21*b* are removed from spreading bar assembly 20 and a downwardly extending grout float 30, having a rubber-like straight edge 32, is installed. In addition, a second downwardly extending grout float 34, having a rubber-like straight edge 36 is installed. Secondary grout float 34 acts as a squeegee and is attached to the trailing end for removing excess grout from the flooring tile surface. Secondary grout float 34 is attached to the frame by reconfiguring arms 16*a* and 16*b* to a vertical configuration such that the lower edge 36, equipped with a rubber-like squeegee, contacts the underlying tile surface for removing excess grout.

In the grout spreading mode the device 10 is positioned over the previously installed flooring tile and a suitable amount of grout is poured in the middle of the frame such that the grout is contained by opposing frame side walls 18*a* and 18*b* and grout float 30. Once again weights are placed on the trailing end corners and the device is dragged across the flooring tile by the user. Rope 40 may be attached to the frame leading end for enabling the user to easily drag the device across the tile. As the device 10 slides across the underlying tile, the plastic coated skids 38 prevent scratching. In addition, grout float 30 forces grout into the gaps existing between the tiles and the trailing end grout float 34 acts as a squeegee and removes excess grout from the tile gaps and the tile surface thereby completing the grouting process.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A combination floor tile mortar and grout spreading device for spreading an even layer of floor tile mortar bonding material over an underlying floor comprising:

a frame having a leading end, a trailing end, and opposing downwardly extending sides defining a width;

a downwardly extending, telescopically adjustable blade pivotally connected proximate said frame trailing end and extending between said opposing frame sides, such that pivoting said blade raises and lowers a blade edge for spreading bonding material at a user selected thickness;

means for telescopically adjusting said frame width;

said opposing frame sides for containing a quantity of bonding material placed on the floor therebetween, whereby sliding said frame across said floor causes said downwardly extending blade to spread the bonding material in a layer corresponding to said frame width.

2. A device as recited in claim 1, further comprising means for anchoring said frame at a predetermined width.

3. A device as recited in claim 1, wherein said downwardly extending blade is a removably attachable notched trowel blade.

4. A device as recited in claim 1, wherein said downwardly extending blade is a removably attachable grout float.

5. A device as recited in claim 1, further including a second downwardly extending telescopically adjustable blade connected proximate said frame trailing end and extending between said opposing frame sides for removing excess grout, said second downwardly extending blade being vertically adjustable relative to the floor, said second downwardly extending blade being a removably attachable grout float.

6. A device as recited in claim 1, wherein said opposing frame sides include non-scratching skids attached thereto to prevent scratching the floor tile.

7. A combination floor tile mortar and grout spreading device for spreading an even layer of floor tile mortar bonding material over an underlying floor, and for applying grout between floor tiles set therein, comprising:

a frame having a leading end, a trailing end, and opposing downwardly extending sides defining a width;

a downwardly extending, telescopically adjustable notched spreading blade pivotally connected proximate said frame trailing end and extending between said opposing frame sides; and means for telescopically adjusting said frame width, whereby telescopic adjustment of said frame width causes a corresponding adjustment of said spreading blade;

said opposing frame sides for containing a quantity of bonding material placed on the floor therebetween, whereby sliding said frame across said floor causes said downwardly extending notched spreading blade to spread the bonding material in a layer corresponding to said frame width.

8. A device as recited in claim 7, further comprising a telescopically adjustable stabilizer bar disposed on an outer surface of said spreading blade for preventing said spreading blade from bowing.

9. A device as recited in claim 7, wherein said spreading blade comprises:

a telescopically adjustable trowel blade having a notched spreading edge defining a plurality of bonding material combing teeth.

10. A device as recited in claim 9, wherein said trowel blade is vertically adjustable.

* * * * *